US006283333B1

(12) United States Patent
Knickerbocker et al.

(10) Patent No.: US 6,283,333 B1
(45) Date of Patent: Sep. 4, 2001

(54) TOGGLE-ACTION DISPENSING CLOSURE WITH AN ACTUATION-PREVENTION ABUTMENT AND A RECESSED STRIKER RIB

(75) Inventors: Michael G. Knickerbocker, Crystal Lake, IL (US); Jeffrey T. Randall; Nicholas J. Jelich, both of Oconomowoc, WI (US); Robert M. Pieters, Delavan, WI (US); Catherine F. Schultz, Eagle, WI (US); Kelly A. Smith, East Troy, WI (US); Terry J. Vandenboom, Kansasville, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/761,956

(22) Filed: Jan. 17, 2001

(51) Int. Cl.[7] ..... B65D 47/00
(52) U.S. Cl. ..... 222/153.14; 222/536
(58) Field of Search ..... 222/153.14, 534, 222/536, 556

(56) References Cited

U.S. PATENT DOCUMENTS

| | | |
|---|---|---|
| 3,502,248 | 3/1970 | Libit et al. . |
| 3,516,518 | 6/1970 | Micallef . |
| 3,568,895 | 3/1971 | Porter . |
| 3,734,359 | 5/1973 | Waterman . |
| 4,487,342 | 12/1984 | Shy . |
| 4,607,768 | 8/1986 | Taber et al. . |
| 4,645,086 | 2/1987 | Rosenthal . |
| 4,776,501 | 10/1988 | Ostrowsky . |
| 4,838,460 | 6/1989 | Moore et al. . |
| 4,962,869 | 10/1990 | Gross et al. . |
| 5,058,775 | 10/1991 | Gross et al. . |
| 5,236,107 | 8/1993 | Spaanstra, Sr. . |
| 5,279,451 | 1/1994 | Mueller et al. . |
| 5,284,264 | 2/1994 | Gross . |
| 5,314,093 | 5/1994 | Gross et al. . |
| 5,341,960 | 8/1994 | Lay . |
| 5,346,100 | 9/1994 | Lay . |
| 5,370,284 | 12/1994 | Dirksing . |
| 5,379,926 | 1/1995 | Mueller et al. . |
| 5,579,961 | 12/1996 | Zimmerman . |
| 5,709,318 | 1/1998 | Oder . |
| 5,862,963 | 1/1999 | Fuchs et al. . |
| 6,026,866 | 2/2000 | Wood et al. . |

*Primary Examiner*—Philppe Derakshani
(74) *Attorney, Agent, or Firm*—Rockey, Milnamow & Katz, Ltd.

(57) ABSTRACT

A toggle-action dispensing closure for a container is provided for manipulation between a closed, non-dispensing orientation and an open, dispensing orientation. The closure includes an actuator pivotally mounted along a tilting axis on a body secured to the container. The actuator is tiltable by applying force to the actuator on one side of the tilting axis so as to move the actuator from a non-dispensing position to a dispensing position. The actuator includes a striker rib extending downwardly at a position between an edge of the actuator and the tilting axis. The body includes a deck defining a dispensing aperture and supporting a post. The post extends vertically to underlie the actuator, preventing tilting of the actuator unless a sufficient opening force is exerted on the actuator to cause the striker rib to shear, or permanently deform, the post. One embodiment includes an angled fracture control surface at the bottom of the post to ensure that the initial minimum required force to shear the post is within a desired range.

22 Claims, 14 Drawing Sheets

TOGGLE-ACTION DISPENSING CLOSURE WITH AN ACTUATION-PREVENTION ABUTMENT AND A RECESSED STRIKER RIB

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a toggle-action dispensing closure for a container, wherein the closure can be manipulated between a closed orientation and an open, dispensing orientation.

BACKGROUND OF THE INVENTION AND TECHNICAL PROBLEMS POSED BY THE PRIOR ART

Designs have been proposed for containers used with flowable substances wherein a closure is provided for being attached to the container mouth and wherein the closure includes a toggle-action actuator, flip-up spout, or nozzle assembly for dispensing the container contents. See, for example, U.S. Pat. Nos. 5,346,100; 5,058,775; 4,962,869; 4,776,501; 4,645,086 and 3,516,581.

The toggle-action closures, such as those disclosed in the above-referenced U.S. Pat. Nos. 5,346,100, 5,058,775, 4,962,869, and 4,776,501, require that the operator push down on a top, rear portion of the closure in order to pivot the actuator of the closure to the dispensing orientation.

When the actuator is pivoted to the dispensing position, a discharge passage in the actuator is in communication with the container contents, and the container contents can flow out through the actuator. Typically, such toggle-action closures are provided on squeezable containers fabricated from a thermoplastic material providing a inwardly deformable, resilient wall structure. When the container wall structure is squeezed, the contents within the container are forced upwardly and out through the open dispensing closure.

During shipping and handling, a toggle-action closure may be accidentally bumped or impacted in a way that causes the closure to pivot to the dispensing orientation. It is then possible for the contents to be discharged. If the container is lying on its side, the contents can leak out of the accidentally opened closure. If the container is in a carton, the carton may be subjected to rough handling causing the wall of the container to be temporarily squeezed inwardly and causing an unwanted discharge of a portion of the container contents through the open closure.

In order to prevent or substantially minimize the potential for leakage or spillage of container contents during shipping and handling of containers provided with toggle-action closures, the closure of the type disclosed in the above-referenced U.S. Pat. No. 4,962,869 was developed. This closure has effectively solved a long-felt need to prevent inadvertent discharge through toggle-action closures during shipping and handling.

The closure disclosed in the U.S. Pat. No. 4,962,869 provides a unique structure which prevents or greatly inhibits the opening of the toggle-action actuator during shipping and handling. In particular, the closure body is provided with an upstanding abutment or resistance post under a rear portion of the toggle-action actuator. The actuator includes a shearing wall for confronting the abutment post when the actuator is initially closed in the non-dispensing position. When a moderate force is applied to the rear of the actuator, the actuator will not tilt upwardly to the open position because the shearing wall engages the abutment.

The abutment is designed to withstand the forces typically encountered during shipping and handling. However, the abutment is designed to be sheared off when the actuator is subjected to at least a predetermined force greater than the forces typically encountered during shipping and handling. When the consumer uses the closure for the first time, the consumer must apply, to the rear of the actuator, a force at least equal to the predetermined force so as to cause the shearing wall to shear off the abutment. Thereafter, the consumer can subsequently open the actuator by applying a much lower force.

U.S. Pat. No. 5,346,100 describes a toggle-action dispensing closure provided for manipulation between a closed, non-dispensing orientation and an open, dispensing orientation. The closure includes an actuator mounted on a body secured to the container. The body has an angular control surface at the base of an abutment which is broken by a shearing wall of the actuator. The control surface influences the fracture of the abutment from the control surface through the abutment. With this surface, the fracture is more likely to occur within a predetermined narrow range of forces applied to the actuator.

The above-discussed designs disclosed in U.S. Pat. Nos. 4,962,869 and 5,346,100 function very well and satisfy the objectives of preventing or inhibiting leakage during shipping and handling. However, the present inventor has recognized that the precise magnitude of the force required to shear off the abutment is not easily determinable, and the required shear force may vary somewhat from closure to closure. The present inventor has recognized that it would be desirable to provide an improved design in which the required shear force is even more predictable and controllable and which, for some applications, could also optionally accommodate adjustment of the design parameters to provide an abutment that would predictably shear off when subjected to a smaller shear force than required for conventional designs.

The toggle-action dispensing closure of the present invention includes a closure body mounted to, or formed with, a container, and a pivotable actuator engaged to the closure body.

The closure body can be adapted for engaging the container over the opening to the container. The body defines a discharge aperture communicating with the container opening.

The actuator is pivotally mounted on the body on a tilting axis for occluding flow from the container through the discharge aperture when the actuator is in a closed, non-dispensing position. The actuator permits flow from the container when sufficient force is applied to the actuator to pivot or tilt the actuator to an open, dispensing position.

The invention provides an improved actuation-prevention abutment extending from the closure body and a recessed striker rib extending from the actuator which together prevent pivoting of the actuator to open the closure unless a sufficient force is exerted on the actuator to force the striker rib to move an otherwise interfering portion of the abutment.

The movable abutment prevents, or reduces the likelihood of, an inadvertent, premature opening or actuation of the closure to the dispensing position during shipping and handling.

Before the closure can be opened for the first time by the consumer, the abutment is moved, such as by a portion thereof being bent or sheared off by the striker rib.

The actuator striker rib extends downwardly toward the body and is in close proximity to the movable abutment when the actuator is in the non-dispensing position. The abutment prevents the complete tilting of the actuator to the dispensing position in response to the actuator being subjected to a tilting force less than a predetermined force. However, when the actuator is subjected to at least the predetermined force, the striker rib moves the abutment to a noninterfering position with respect to the actuator so that, thereafter, the actuator can be tilted to the dispensing position in response to the application of a force less than the predetermined force. The movable abutment is "movable" in that a portion can either be sheared from the body or permanently bent over with respect to the body.

The striker rib is located within a periphery of the actuator, recessed inwardly of a rear wall of the actuator. The movable abutment is also located recessed inwardly from a rear wall of the body, and located inwardly from the striker rib when the actuator is in a closed position, before the initial opening of the closure. By using an inwardly located striker rib instead of a shearing wall located at a rear of the actuator, a lever mechanical advantage is achieved. A tilting force exerted on a rear edge of the actuator at a first distance from the tilting axis of the actuator is multiplied at the striker rib, which is located at a second, shorter distance from the tilting axis.

In the embodiment wherein the movable abutment is sheared by the striker rib, in order to control the manner in which, and the force at which, the abutment is sheared, the body has a control surface at the base of the abutment. The control surface is obliquely angled and extends out from the front and rear surface of the abutment, and preferably also extends laterally from the sides of the abutment. The control surface controls the direction of fracture of the abutment. With this surface, fracture is more likely to occur within a predetermined narrow range of forces applied to the abutment via a force on the actuator.

The toggle-action dispensing closure of the present invention is adapted to be mounted over or formed on, the opening of a container, especially a container of the type having a generally flexible wall portion which can be squeezed to assist in dispensing the contents from the container.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENT

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, the closure of this invention is described in an upright position, and terms such as upper, lower, horizontal, etc., are used with reference to this position. It will be understood, however, that the closure of this invention may be manufactured, stored, transported, used, and sold in an orientation other than the position described.

Figure 1:
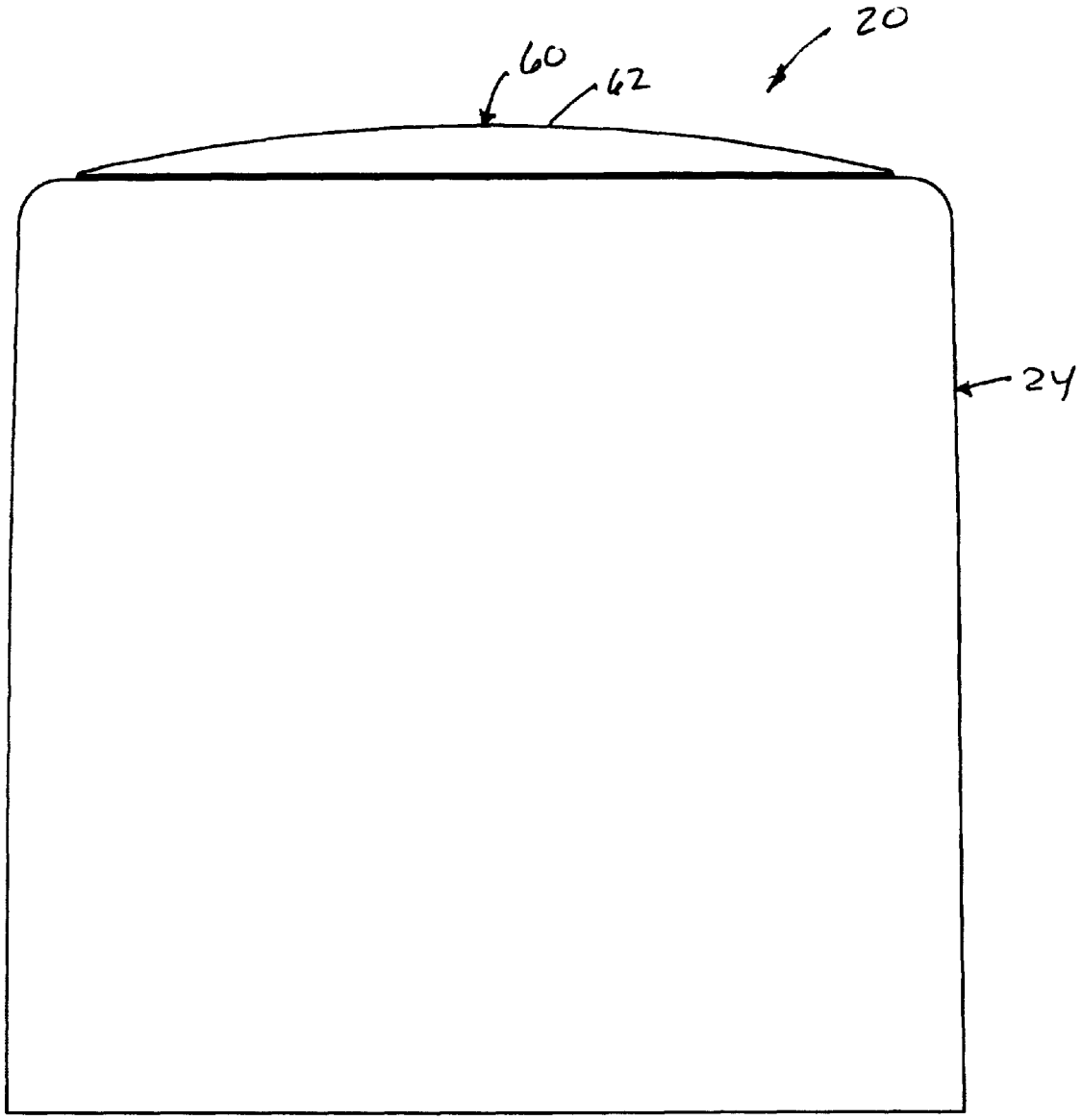
FIG. 1 is a front view of an embodiment of a closure of the present invention, shown in a non-dispensing, closed condition prior to installation on a container.
Figure 2:
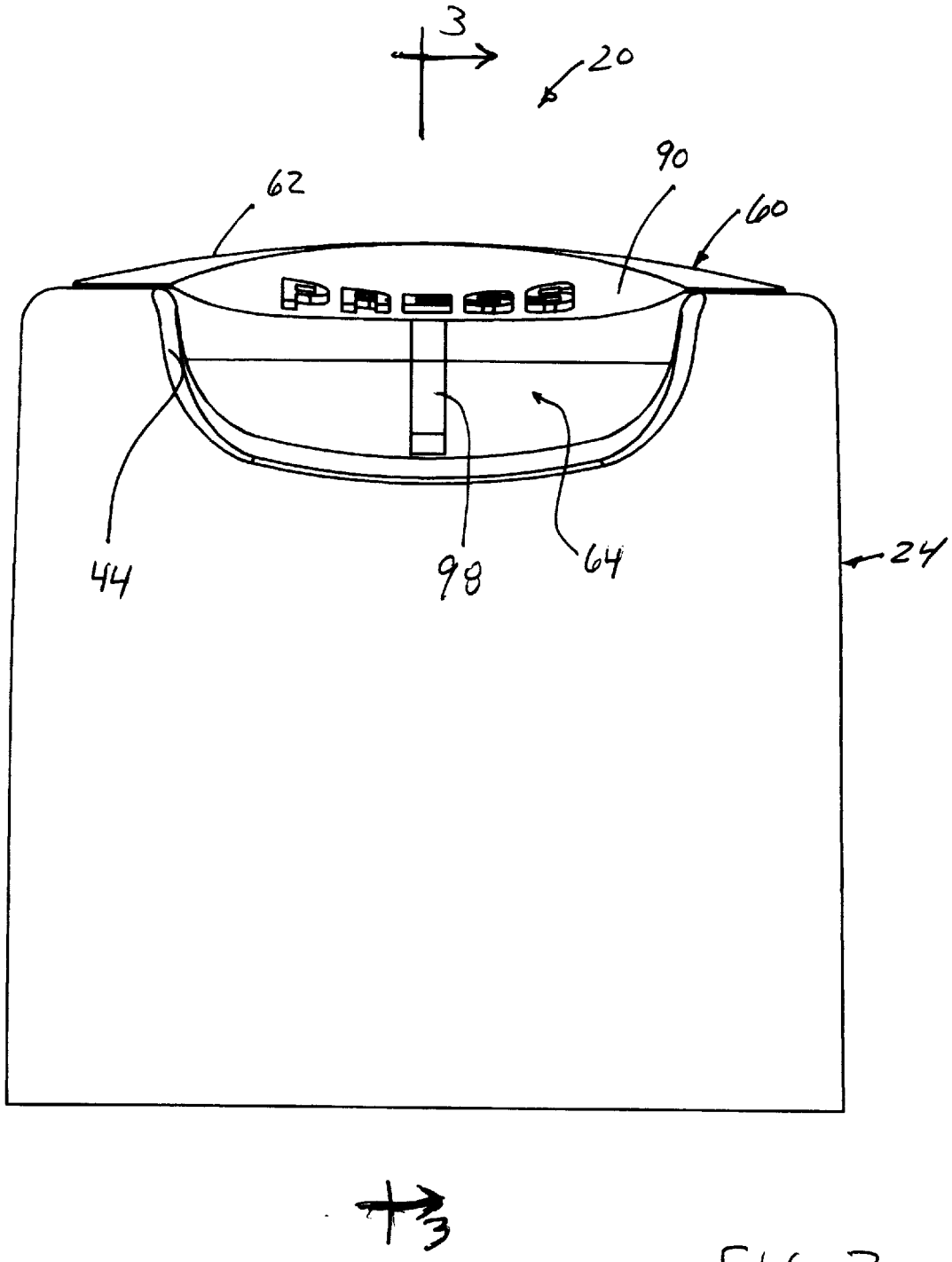
FIG. 2 is a rear view of the closure shown in a non-dispensing, closed condition.
Figure 3:
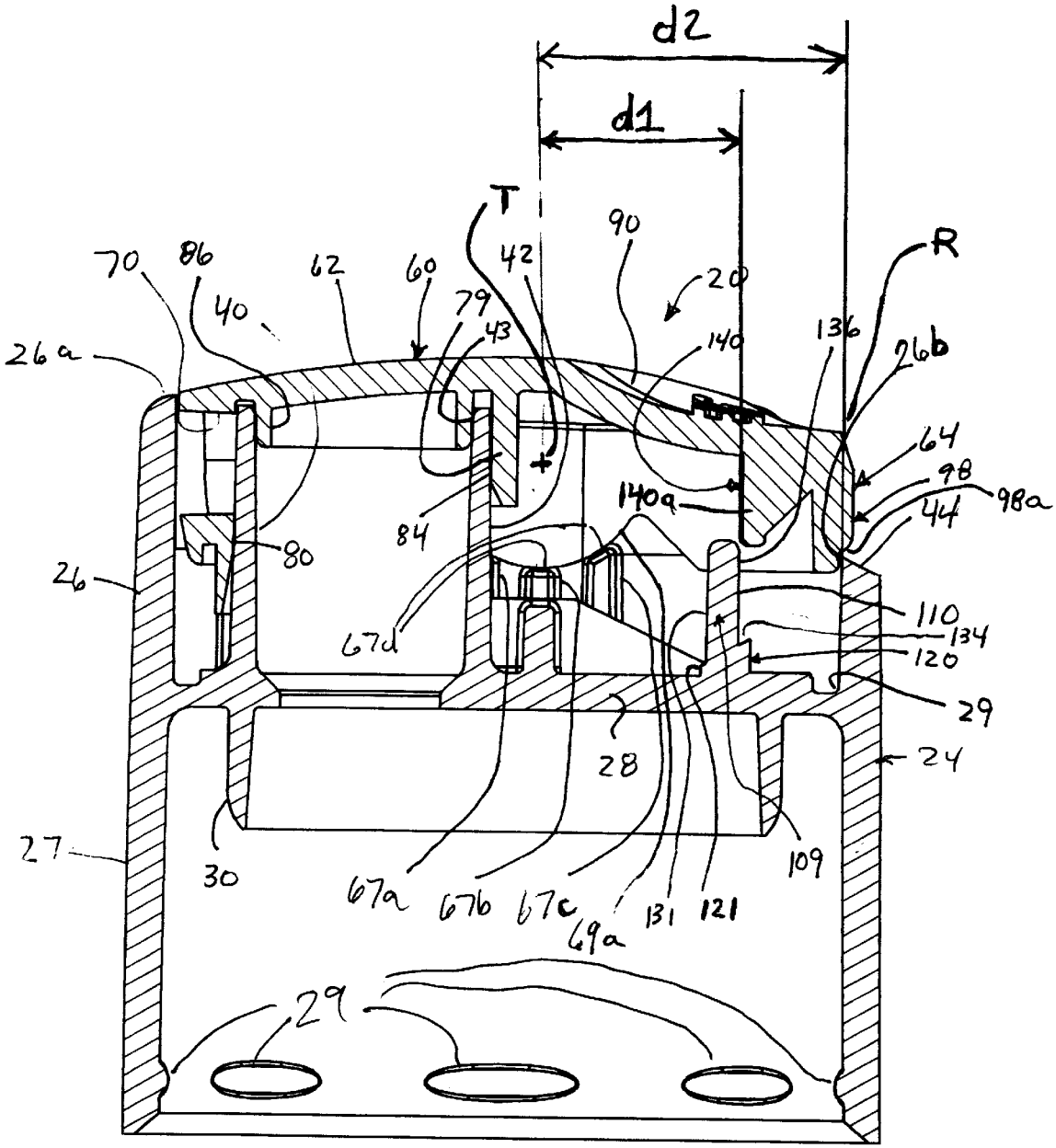
FIG. 3 is a sectional view taken generally along line 3—3 of FIG. 2.

FIGS. 1 through 3 show an embodiment of the dispensing closure structure of the present invention. In this embodiment, a closure is illustrated in a closed, non-dispensing condition wherein the closure is represented generally by reference numeral 20. The closure 20 is adapted to be mounted on a container (not illustrated) which may have a conventional open mouth defined by a neck (not illustrated) or other suitable structure. Alternatively, at least part of the closure could be formed unitarily with a container. In either case, the container would advantageously be of the type having a generally flexible wall portion which can be squeezed to assist in dispensing the contents from the container.

The closure 20 includes a closure base or body 24 for securement to the container. As seen in FIG. 3, the body 24 includes a generally cylindrical, upper wall 26 and a generally cylindrical, lower wall 27. A generally transverse closure wall or deck 28 (FIGS. 3 and 4) extends across the body 24 between the upper wall 26 and lower wall 27.

The lower, cylindrical wall 27 of the closure body 24 is adapted to engage the outer periphery of the top of the container neck (not illustrated) around the container mouth, as with snap fit elements 29. Other suitable engaging means (e.g., threads) may be provided to secure the closure body 24 to the container. Alternatively, in some applications, the closure body 24 could be non-releasably attached to, or formed unitarily with, the container.

An annular plug seal 30 may be provided for engaging an interior edge of the container neck at the container mouth to effect a tight seal. Other known seals such as a "crabs claw" seal can also be used instead of the plug seal.

Figure 4:
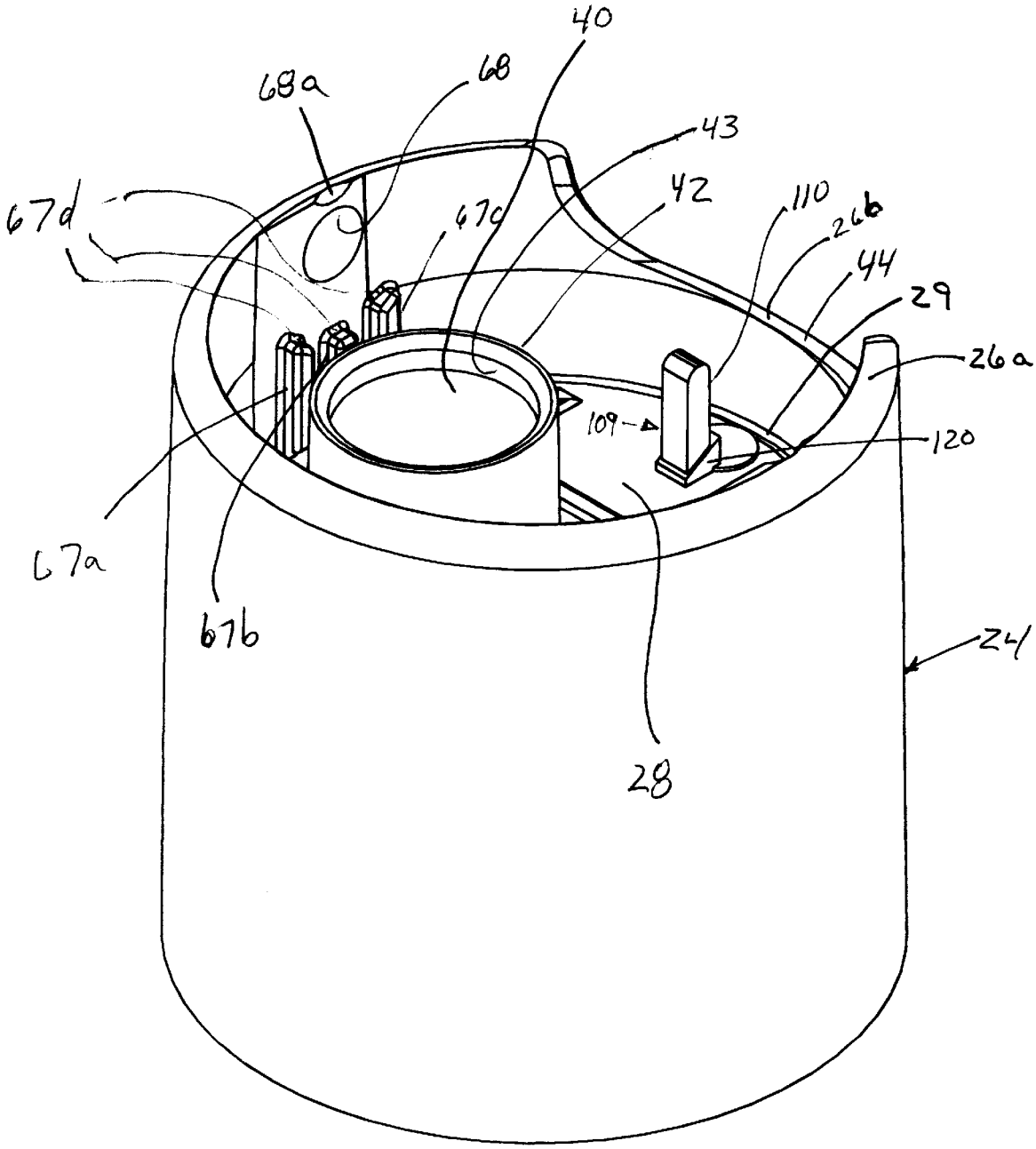
FIG. 4 is a perspective view of a body part of the closure of FIG. 1.

The closure body 24 includes a discharge passage 40 through the deck 28 (FIGS. 3 and 4). In the preferred embodiment, the passage 40 is formed by a discharge tube 42 projecting upwardly from the deck 28, wherein a discharge aperture 43 is formed at an end of the tube 42. The discharge aperture 43 may be defined by a slightly convex sealing bead around the inner periphery of the upper end of the tube 42. The tube 42 communicates fluid through the deck 28 from the container interior at the lower end of the tube 42.

As shown in FIGS. 3 and 4, the cylindrical, upper wall 26 of the closure body 24 extends upwardly above, and around, the deck 28. A rear portion of the wall 26 above the deck 28 defines a fingerwell or finger recess area 44 in the form of a cutout or notch from the top edge 26*a* of the wall 26.

Figure 6:
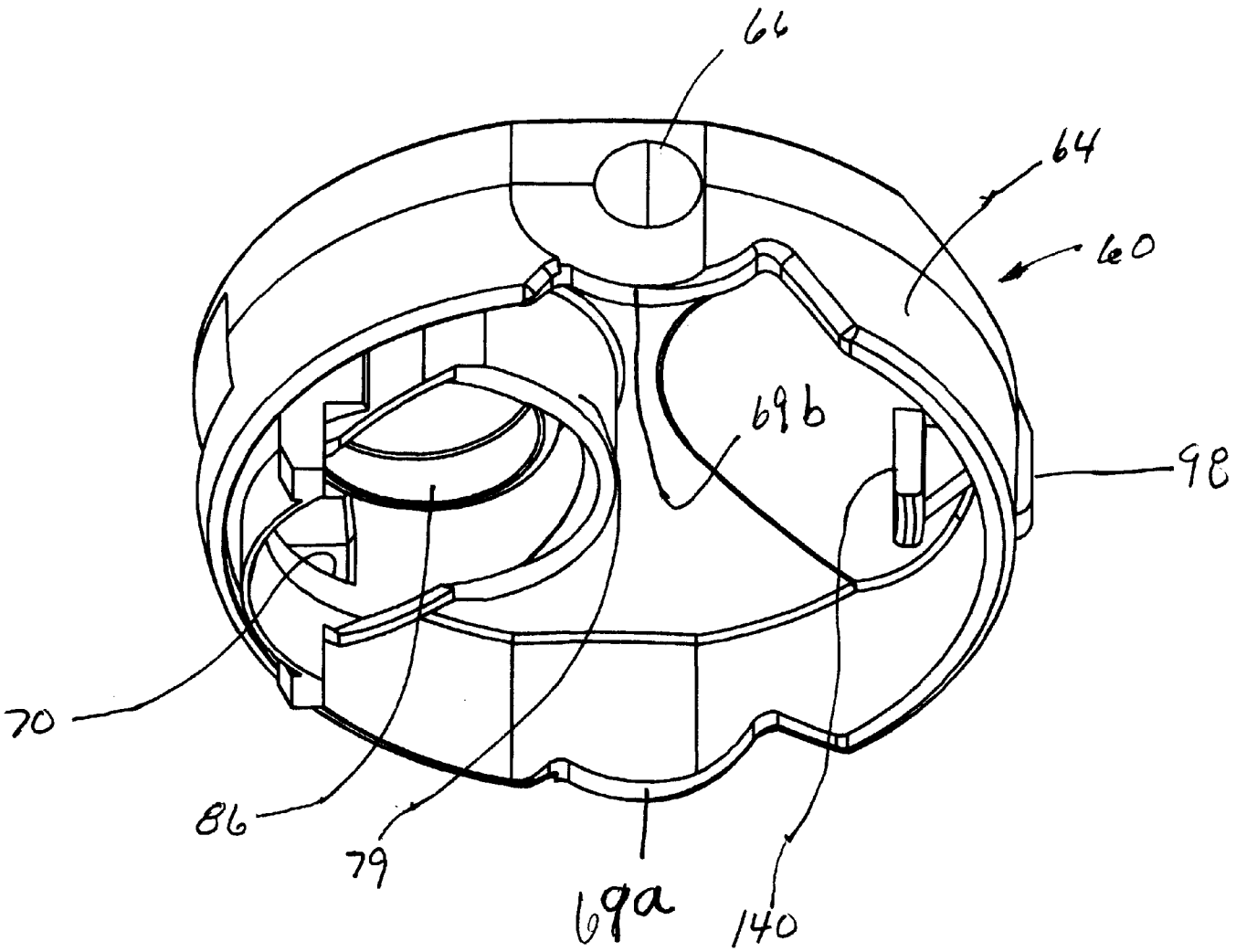
FIG. 6 is a bottom, side perspective view of an actuator part of the closure of FIG. 1.
Figure 7:
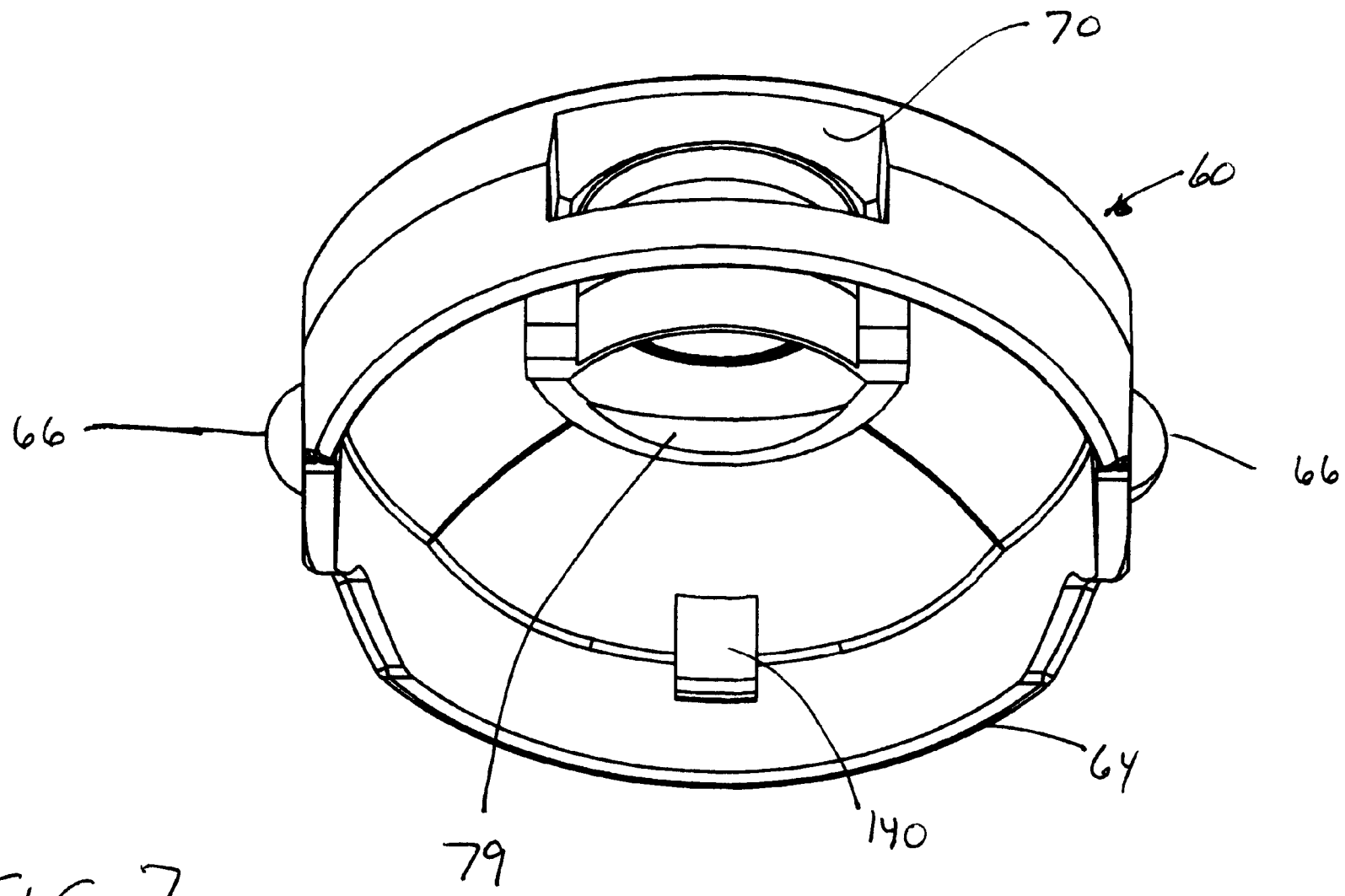
FIG. 7 is a front, bottom perspective view of the actuator part of FIG. 6.

The closure body 24 receives a generally disc-like nozzle assembly or actuator 60 (FIGS. 3, 6, 7, 9, 10). The actuator 60 includes a transverse top wall 62 and a peripheral flange 64. At each of two diametrically opposed portions of the flange 64, there is a projecting, hemispherical protuberance or pivot member 66 (FIGS. 6 and 7).

The pivot members 66 cooperate with the closure body upper wall 26 to mount the actuator 60 for pivoting movement within the closure body 24. To this end, the inner surface of the closure body wall 26 defines two hemispherical recesses 68 (one shown in FIG. 4) for mating each with one of the pivot members 66, to provide a snap-action engagement of each pivot member 66 and respective recess 68. Also, the body 24 provides a group of three spaced-apart side columns 67*a*, 67*b*, 67*c* on each side, adjacent recess 68, which each have an arcuate top surface 67*d*, and which, as a group may be characterized as defining an arcuate top support surface. The actuator 60 includes side cams 69*a*, 69*b* which slide on the surfaces 67*d* (FIGS. 3 and 4). The surfaces 67*d* support the actuator 60 during the pivoting movement of the actuator 60 about a tilting axis T (FIGS. 9 and 10) defined by the pivot members 66 and receiving recesses 68.

Figure 12:
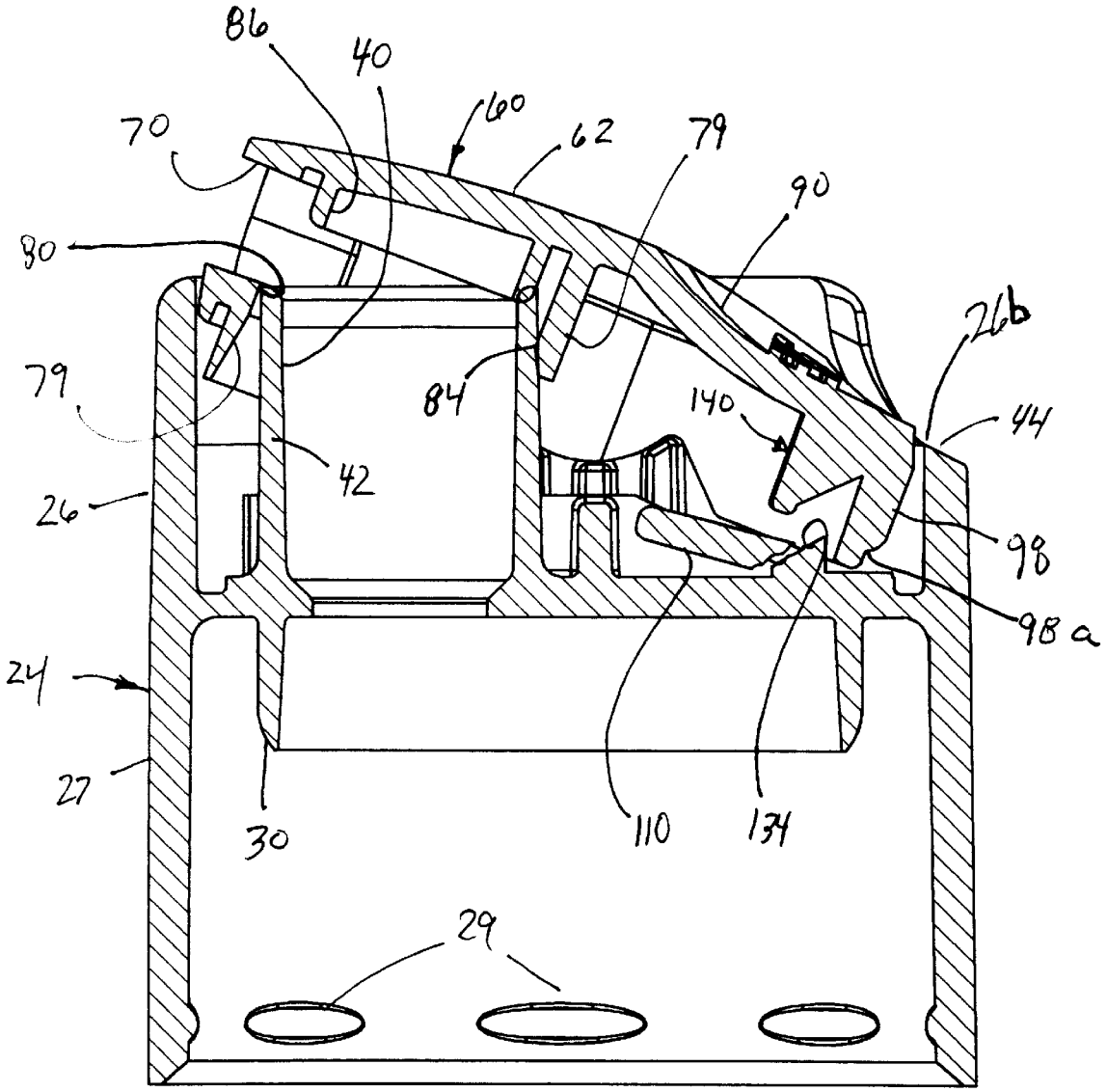
FIG. 12 is a sectional view of the closure as illustrated in FIG. 11, but in a final stage of being opened to the full open condition.
Figure 13:
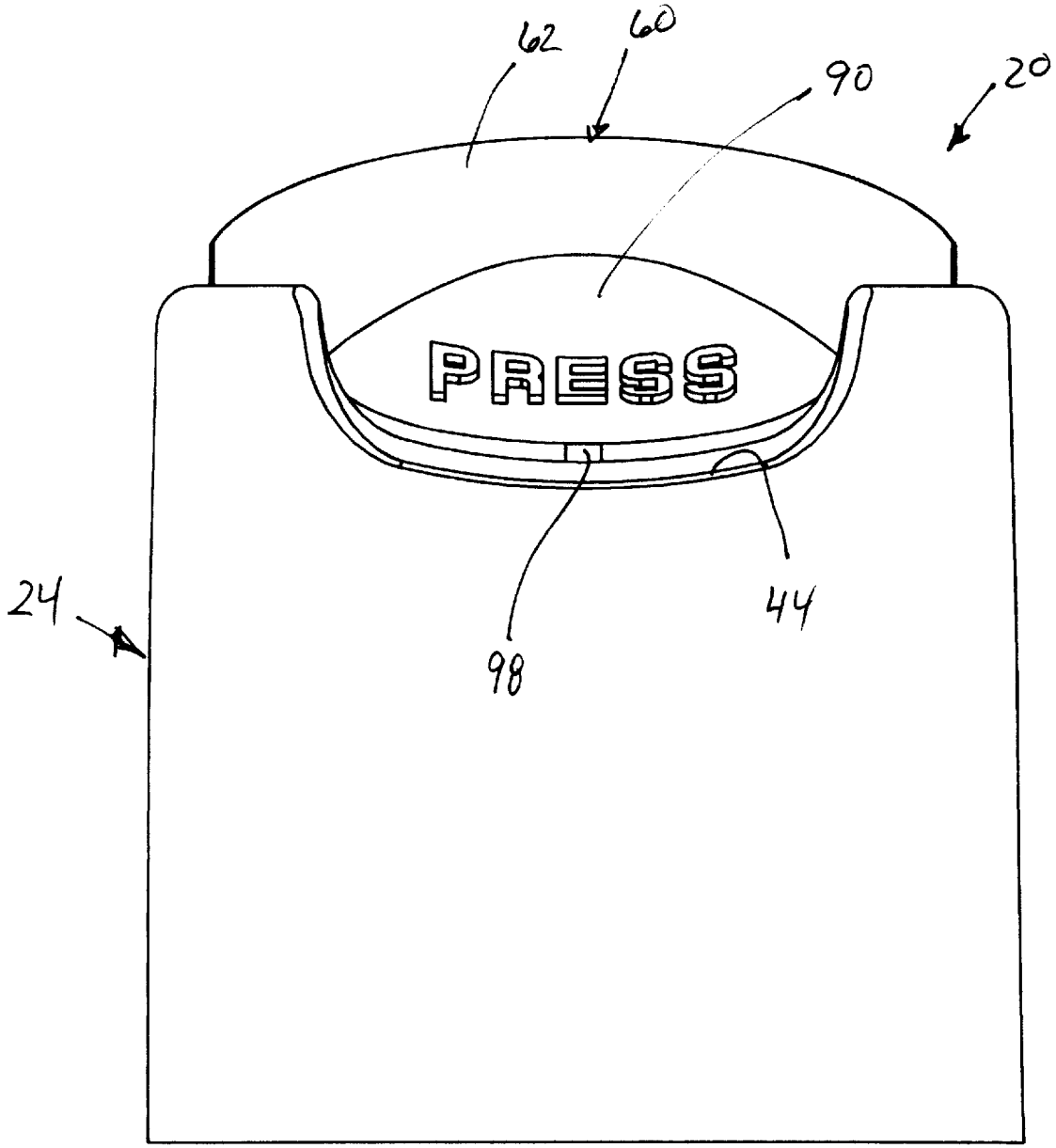
FIG. 13 is a rear view of the closure in the full open condition as illustrated in FIG. 12.
Figure 14:
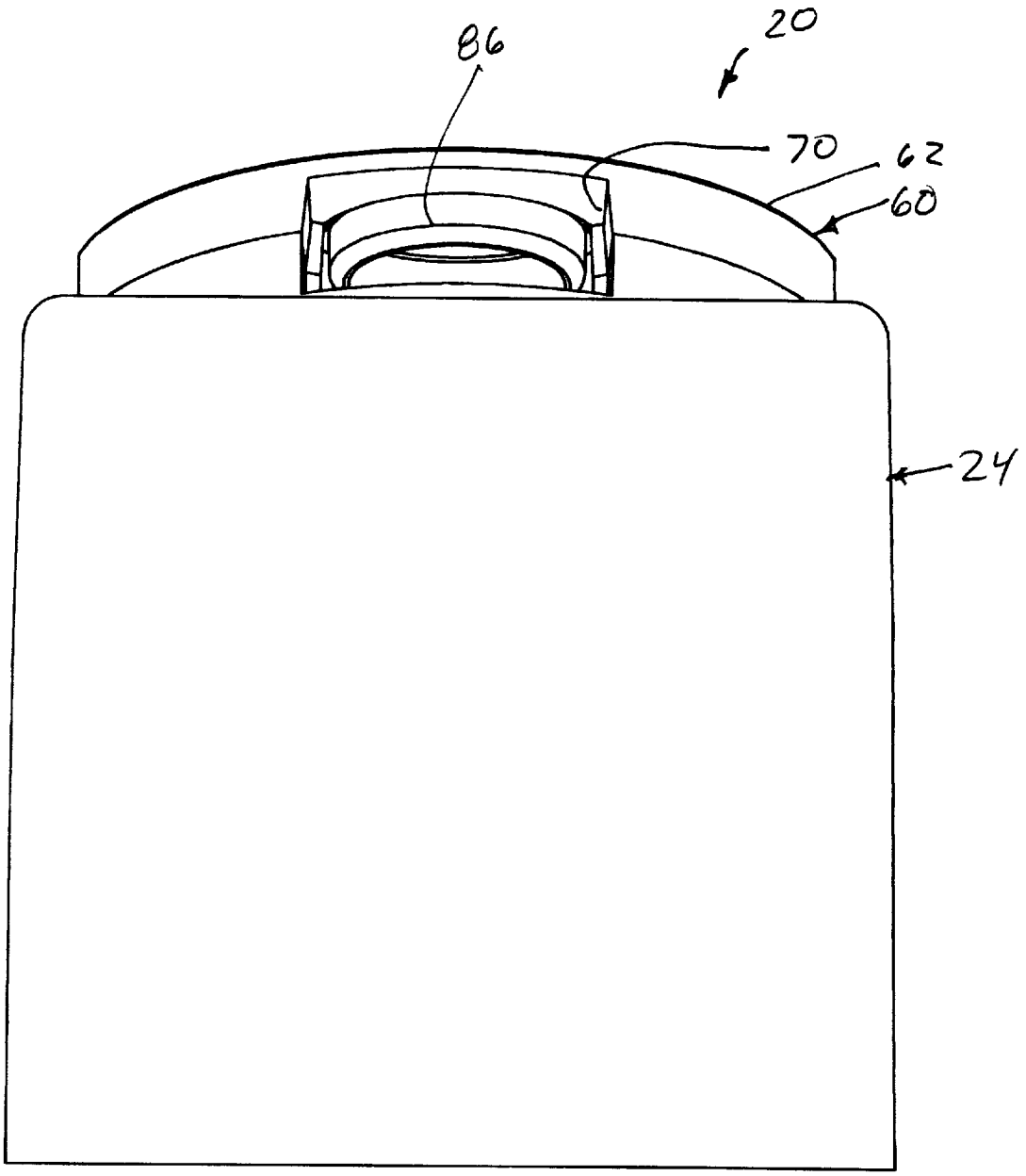
FIG. 14 is a front view of the closure in the full open condition as illustrated in FIG. 12.

The top edge 26*a* of the wall 26, above each recess 68, may be provided with a chamfer 68*a* (FIG. 4) for facilitating assembly. When the body 24 and actuator 60 are assembled, the actuator pivot members 66 and body recesses 68 function as mounting means so that the actuator 60 can be pivoted or tilted about the tilting axis T (by pushing downwardly on the rear portion of the actuator 60) until the forward end is exposed above the closure body wall 26 as illustrated in FIGS. 12 through 14.

The actuator 60 includes a structure on the bottom surface of the top wall 62 which functions—depending upon the orientation of the actuator 60—to either permit dispensing of flowable material from the body discharge tube 42 or occlude the tube passage 40 so as to prevent flow out of the discharge tube 42. In particular, the actuator 60 includes a forwardly extending nozzle or channel 70 which merges with, and opens into, a stepped, cylindrical sealing wall 79 (FIGS. 3, 6, 7 and 12).

The wall 79 surrounds and seals the upper periphery of the discharge tube 42 when the actuator 60 is in the closed position as illustrated in FIG. 3. In particular, the wall 79 forms a seal around the outer periphery of the discharge tube 42 as indicated by reference number 80 at the front of the tube 42 and as indicated by the reference numeral 84 at the rear of the tube 42.

Preferably, a sealing plug 86 (FIGS. 3 and 6) projects downwardly from the bottom of the actuator top wall 62. The sealing plug 86 has a generally cylindrical or annular configuration and is adapted to enter into the discharge aperture 43 at the top of the discharge tube 42 to sealingly occlude the discharge passage 40 when the actuator is in the closed position as illustrated in FIG. 3.

Figure 11:
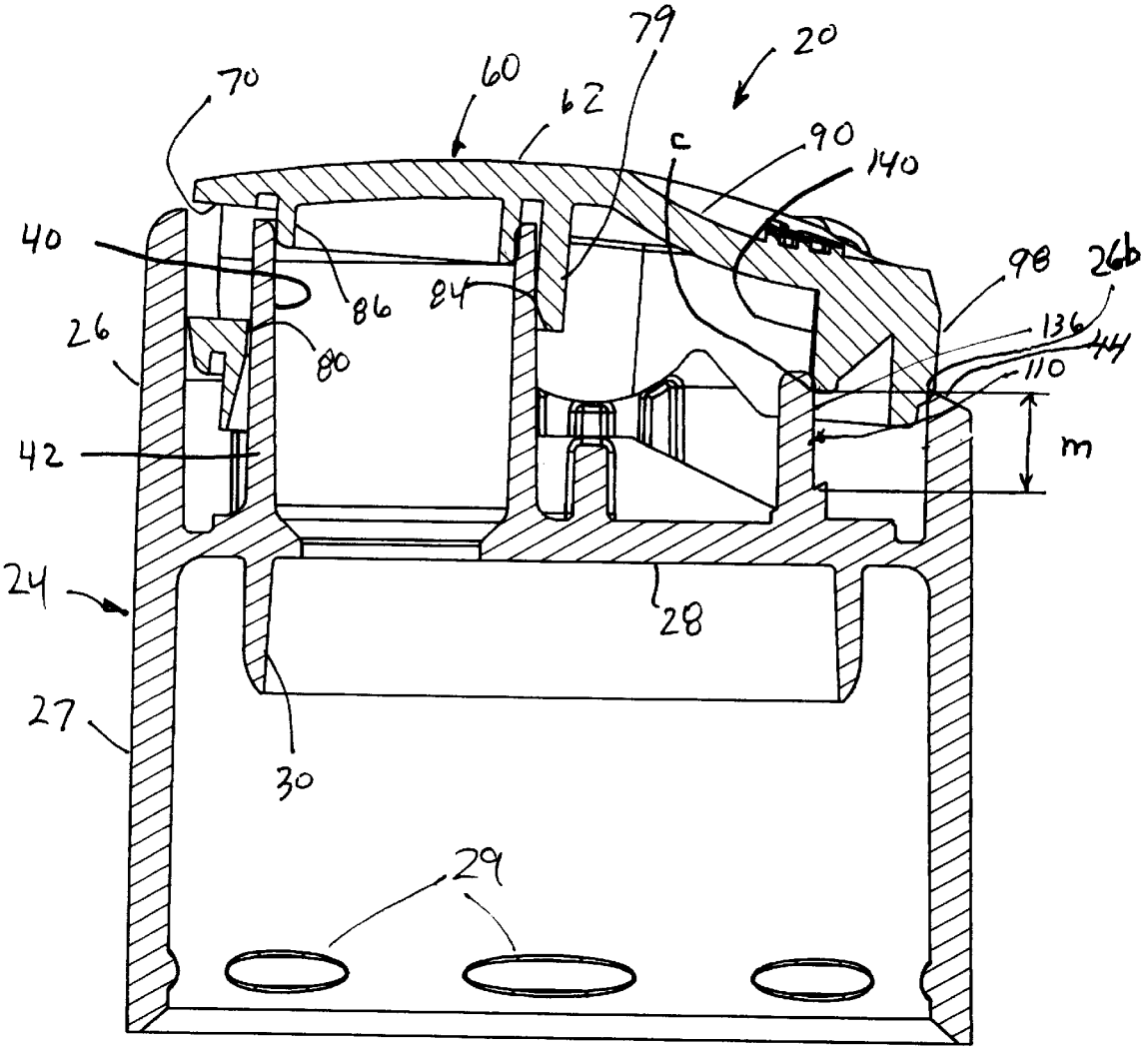
FIG. 11 is a sectional view of the closure as illustrated in FIG. 3, but in an initial stage of being opened.

On the other hand, when the rear of the actuator 60 is pushed down to tilt the actuator to the dispensing position, as illustrated progressively in FIGS. 3, 11, and 12, the front portion of the sealing plug 86 is tilted away from the top of the discharge tube 42 to permit flow of the material out of the discharge aperture 43 of the tube 42 and through the dispensing nozzle 70. When the actuator 60 is tilted completely to the full open dispensing position as illustrated in FIG. 12, the wall 79 still continues to seal the outer periphery of the upper end of the discharge tube 42 so that the container contents, while being dispensed into the nozzle 70, cannot leak out around the top of the discharge tube 42.

The actuator 60 can be pivoted to the open position by applying a downwardly directed force at a location on the top of the actuator 60. To this end, a rear portion of the actuator top wall 62 is recessed within a concave surface or finger well 90 (FIGS. 2 and 3) for receiving the end of a thumb or finger.

A lug 98 (FIGS. 2, 3 and 6) projects rearwardly from the outer, vertical surface of the actuator peripheral flange 64 at the rear of the actuator 60. As illustrated in FIGS. 3 and 11, the closure body cylindrical, upper wall 26 defines an edge 26*b* which underlies an engagement surface, such as an angled bottom surface 98*a* of the lug 98, on the back of the actuator 60. When the actuator 60 is forcibly tilted to the dispensing position (FIG. 11), the lug resiliently displaces the edge 26*b* rearwardly, to pass thereby.

The lug 98 serves to provide a resilient catch for the actuator 60 in the closed position which must be overcome by a slight force as it is being pivoted to the open position. The lug 98 clears the surface 26*b* when it is completely open (FIG. 12). The actuator 60 can be returned to the closed position by pushing down on the front part of the actuator. The actuator flange 64 and/or the closure body finger recess rear wall portion 44 are sufficiently resilient to permit the bottom surface 98*a* of the lug 98 to move past, and snap above, the surface 26*b* when the actuator returns to its closed condition (FIG. 3).

In accordance with the present invention, a permanently deformable and/or severable abutment 109 (FIGS. 3, 4, 5), is provided to prevent accidental, first time movement of the actuator 60 to the open, dispensing orientation shown in FIG. 12. This provides a closure which is resistant to inadvertent actuation during shipping and handling, prior to first use by a consumer.

Figure 5:
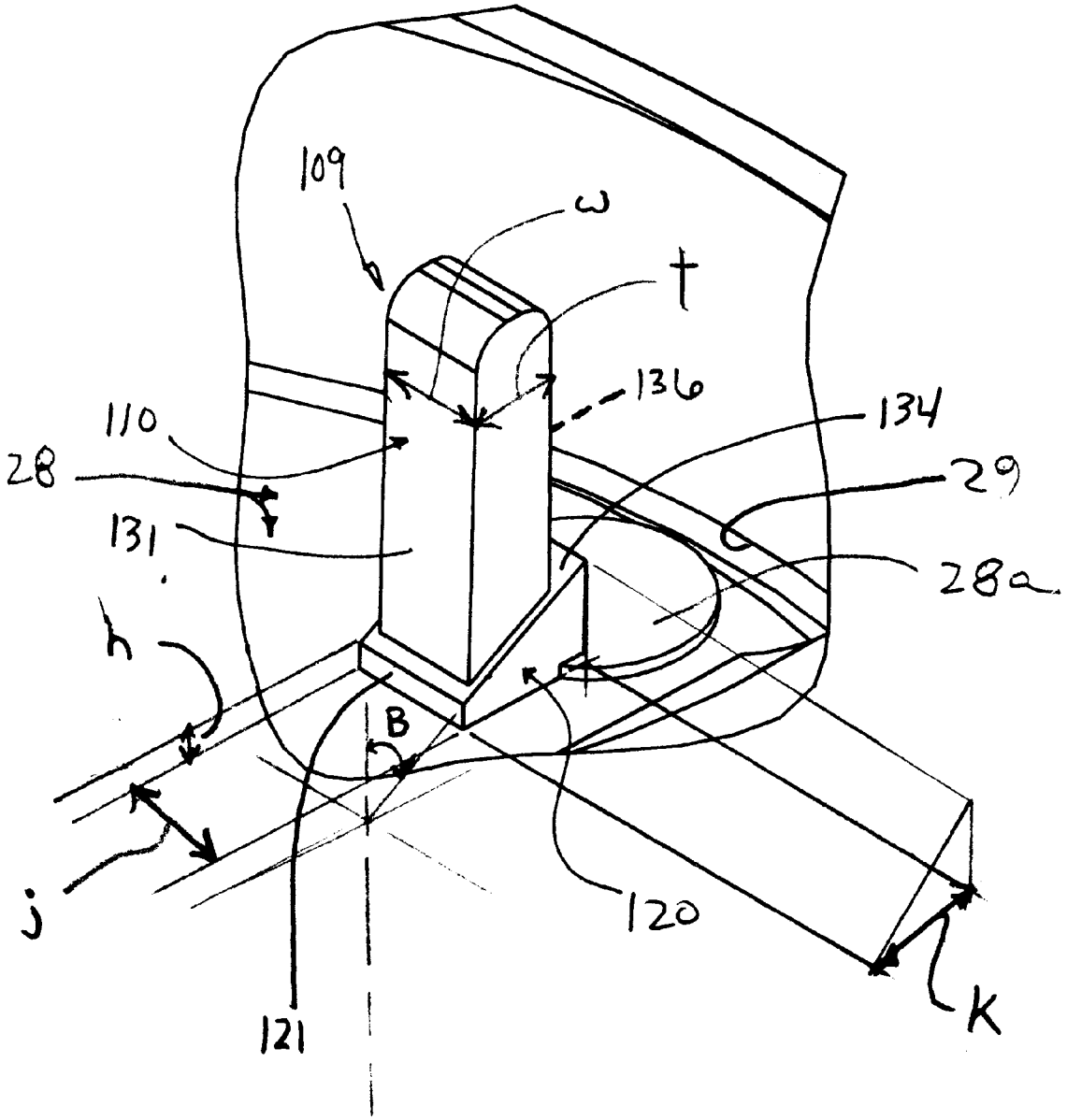
FIG. 5 is an enlarged, fragmentary perspective view of a portion of the body part shown in FIG. 4.

The abutment 109 includes a post 110 and a base 120. The post 110 is located between the tilting axis T of the actuator 60 and a rear edge 29 of the body deck 28, and projects upwardly from the base 120 (FIGS. 3 and 5). The base 120 extends upwardly from the body deck 28. The post 110, in the illustrated preferred embodiment, has a generally rectangular transverse cross-section, four planar sides, and a substantially semicylindrical top. The top is preferably defined by a small, flat, planar surface that merges on either side with an arcuate surface which is preferably partially cylindrical. As shown in FIG. 5, for a closure with an outside diameter of about 1.25 inches, the post 110 has a preferred thickness dimension t of about 0.05 inches, and a preferred width dimension w of about 0.06 inches (FIG. 5). As shown in FIG. 11, the post 110 extends a preferred distance m of about 0.14 inches between a lowest point of contact c by the striker rib and the base 120. The base 120 can have a planar front face 121 that extends upwardly at a forward side a distance h of about 0.015 inches from the deck 28. The base can have a lateral dimension j of about 0.070 inches and a lengthwise dimension k of about 0.080 inches (FIG. 5).

The post 110 has a front surface 131 facing inwardly toward the center of the closure. One side of the post 110 faces rearwardly and is defined by a generally planar, engaging surface 136. The base 120 has an inclined, generally rectangular top surface which defines a fracture control surface 134. The surface 134 extends from a position rearwardly of the engagement surface 136 of the post 110 to a position forwardly of the front surface 131 of the post 110. The fracture control surface 134 extends laterally ("lateral" direction being parallel to the tilting axis T) beyond side surfaces of the post 110 (FIG. 5).

FIG. 5 illustrates the fracture control surface 134 sloping down forwardly and oriented at an oblique angle B relative to the longitudinal axis (vertical axis as oriented in FIG. 3) of the closure. In the preferred embodiment, the angle of the fracture control surface 134 is about 60 degrees. In the preferred embodiment, wherein the post 110 has the engaging surface 136 which is oriented parallel to the longitudinal axis of the closure, the angle defined between the engaging surface 136 and the fracture control surface 134 is also about 60 degrees. Although the preferred embodiment incorporates a planar fracture control surface, other shapes could be employed.

Figure 8:
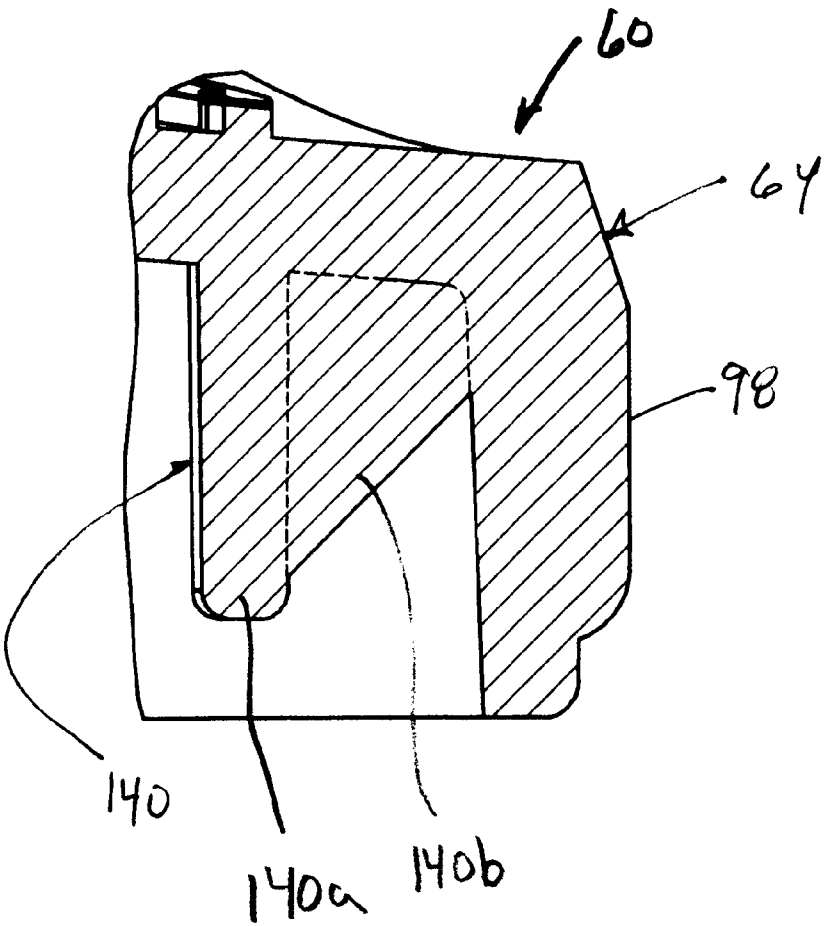
FIG. 8 is an enlarged, fragmentary cross-sectional view taken from FIG. 3.
Figure 9:
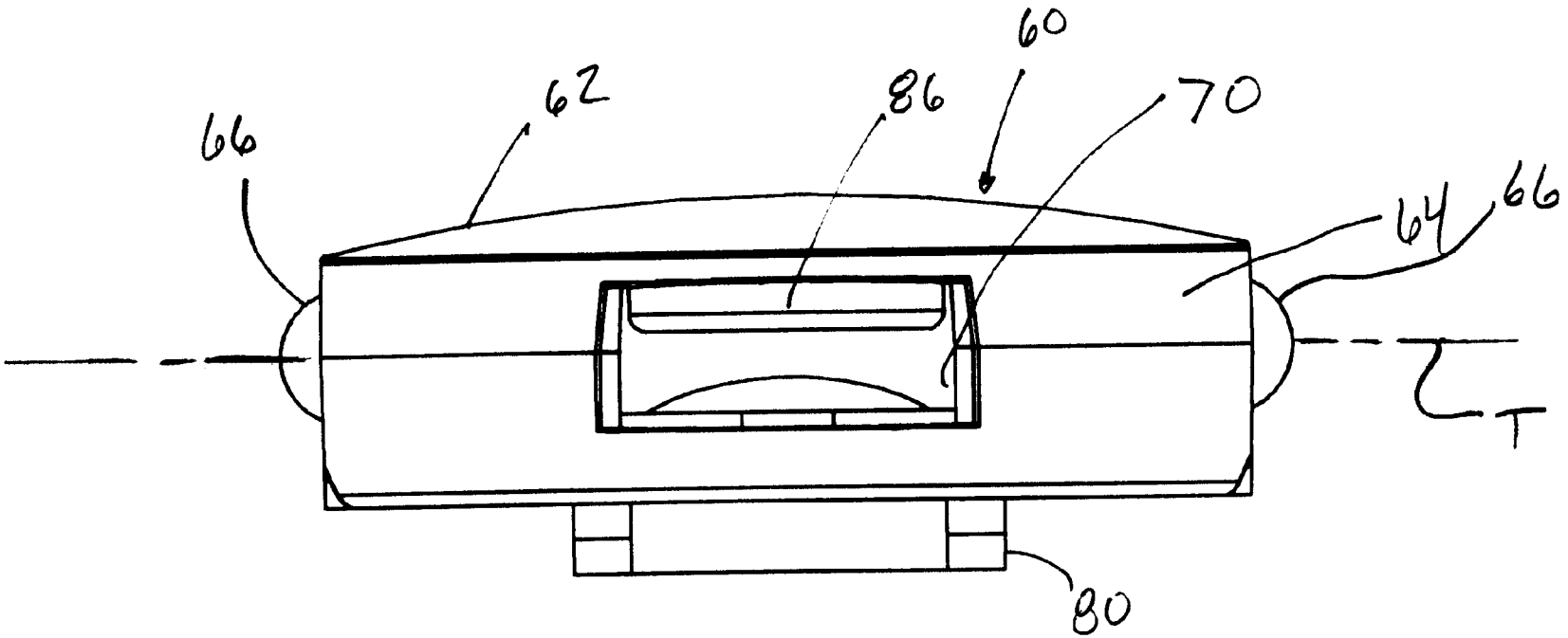
FIG. 9 is a front view of the actuator shown in FIG. 6.
Figure 10:
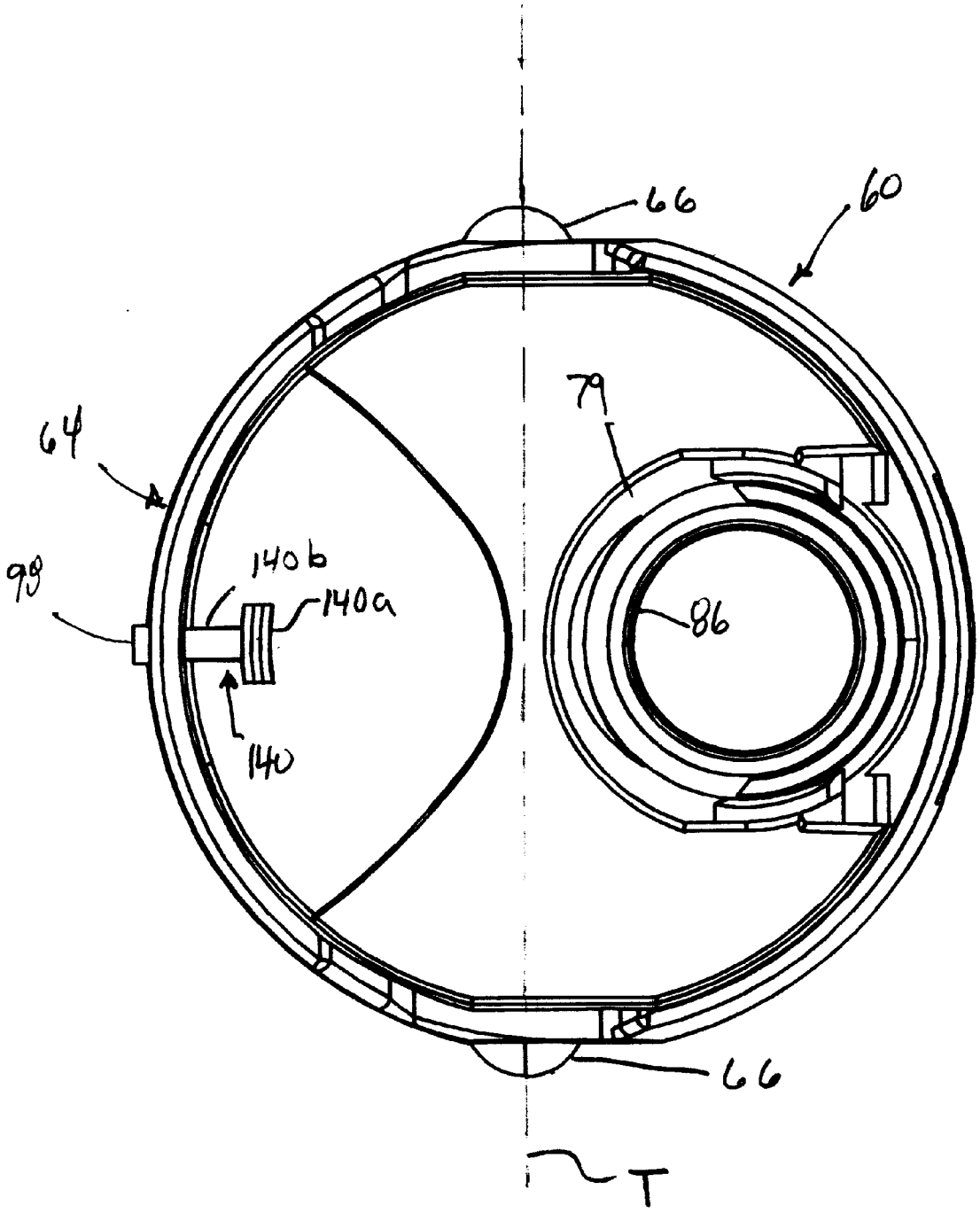
FIG. 10 is a bottom view of the actuator shown in FIG. 6.

A striker rib 140 (FIGS. 6, 7, 8, 10, 11, and 12) extends downwardly from a bottom surface of the actuator 60. It is arranged to be positioned behind the post 110 when the actuator is in the closed position shown in FIG. 3. The striker rib 140, as shown in FIGS. 8 and 10, includes an engagement plate 140*a* which is reinforced by a backing rib 140*b*, forming a T-shaped profile taken in a horizontal plane (FIG. 10). The engagement plate 140*a* is preferably slightly concave or curved to help retain the post 110 in contact with a central portion of the engagement plate 140*a* during forced movement of the post 110 by the striker rib 140, i.e., to prevent the post from bending laterally and slipping behind the striker rib.

The interaction between the edge 26*b* of the closure body finger recess 44 and the actuator lug 98 tends to retain the actuator in the closed, non-dispensing position of FIG. 3. However, when a sufficient force is applied to the top, rear portion of the actuator 60, the striker rib 140 moves part way down behind the post 110 and then engages the post rear surface 136 as illustrated in FIG. 11.

At this position, forces to which the actuator 60 may be subjected during shipping and handling are typically insufficient to deform or shear the post 110. Thus, the actuator 60 cannot be tilted to any significant extent away from the closed, non-dispensing position when the actuator is subjected only to such forces.

When a consumer subsequently wishes to use the closure for the first time, the consumer initially applies a substantially greater force to the actuator finger well 90. A force equal to, or greater than, a predetermined force will drive the striker rib 140 against the surface 136 of the post 110 with a force sufficient to sever the post 110 from the base 120.

To assist in severing the post 110, the striker rib 140 is arranged to have its engagement plate 140*a* at a distance d1 from the tilting axis T (FIG. 3), which is less than a distance d2 between the tilting axis T and a rear edge R of the finger well 90. Thus, pressing the actuator in the region adjacent the edge R provides a lever-mechanical advantage to multiply the force that the striker rib exerts on the post 110. For the closure with the outside diameter of 1.25 inches, and the post 110 dimensions of t being about 0.05 inches, w being about 0.060 inches, and m being about 0.14 inches, the distance d1 is preferably about 0.32 inches and the dimension d2 is preferably about 0.49 inches. The distance d1 is therefore about 65% of the distance d2.

The post 110 is severed as a result of a fracture which is initiated at the convergence of the angled fracture control surface 134 with the engaging surface 136 of the post 110. This location defines a first stress riser, and the fracture begins along the convergence of the two surfaces and then propagates through the cross-section of the post 110. A notch can be formed at this location to assist in propagating the fracture. The fracture tends to be directed along a path which is a continuation of the angled fracture control surface 134. The fracture should terminate at a second stress raiser located at the intersection of the front surface 131 of the post 110 and the fracture control surface. However, it has been found that the fracture, in many cases, may extend in a somewhat uneven manner at an angle that may be less than the angle of the control surface 134. That is, the angle of the fracture surface may be closer to a horizontal orientation.

In any event, the fracture tends to occur within a more narrow range of forces applied to the top of the actuator 60 due to the control surface 134.

The deck 28 is reinforced by a circular boss 28*a* (FIG. 5) located beneath a rear edge region of the base 120. The boss 28*a* prevents tearing of the deck 28, and consequent leaking, at what would otherwise be a stress riser connection between the base 120 and the deck 28. This helps to ensure that fracture occurs along the fracture control surface 134.

Once the post 110 has been sheared off, the actuator can be subsequently closed and then reopened as necessary. The subsequent reopening of the actuator requires considerably less force than is required to initially shear off the post 110. The force required for subsequent actuation need only be great enough to overcome the interfering engagement between the lug 98 and edge 26*b* of the body wall 26 (as well as any other snap fit interference features that may be employed to provide a small retention force on the actuator in the closed position).

Although the preferred embodiment post 110 is designed to be sheared from the base 120 during initial opening of the closure, the invention also encompasses a design wherein the post 110 is bent over, preferably permanently, rather than sheared off, during initial opening of the closure. In this alternate embodiment, the post would be sufficiently permanently deformed to allow subsequent opening of the closure without interference between the post and the actuator.

The closure of the present invention can be readily molded from thermoplastic materials, such as polypropylene, and easily assembled to provide a streamlined product. The closure provides a desirable toggle-action dispensing operation.

It will be readily apparent from the foregoing detailed description of the invention and from the illustrations thereof that numerous variations and modifications may be effected without departing from the true spirit and scope of the novel concepts or principles of this invention.

What is claimed is:

1. In a toggle-action dispensing closure for an opening to a container wherein said closure includes:

a body for engaging said container over said opening and defining a discharge aperture communicating with said opening; and an actuator pivotally mounted about a tilting axis on said body for occluding flow from said container through said discharge aperture when said actuator is in a closed, non-dispensing position and for permitting flow from said container when force is applied to said actuator to tilt said actuator to an open dispensing position, said body having a movable abutment under said actuator for confronting said actuator when said actuator is in said non-dispensing position to prevent tilting of said actuator to said dispensing position in response to said actuator being subjected to a force less than a predetermined force, but said abutment being moved by said actuator when said actuator is subjected to at least said predetermined force so that thereafter said actuator can be tilted to said dispensing position in response to the application of force less than said predetermined force, the improvement comprising:

said actuator comprising a pressing surface on an outside thereof for forcible pivoting of said actuator to said dispensing position, said pressing surface extending to an edge of said actuator at a distance from said tilting axis, and said actuator comprising a striker rib extending from an inside of said actuator and located between said tilting axis and said edge, said striker rib arranged and configured to confront said movable abutment and to move said movable abutment to allow said actuator to pivot to said dispensing position, the distance from said tilting axis to said striker rib being about 65% of the distance from said tilting axis to said actuator edge to increase the mechanical advantage of the application of force to said abutment.

2. The closure in accordance with claim 1, wherein said abutment includes a post that includes an engaging surface facing said striker rib; and a base supporting said post which defines a generally planar fracture control surface beneath said post that extends outwardly of said post, forwardly and rearwardly, and defines an oblique angle between said engaging surface and said control surface.

3. The closure in accordance with claim 2, in which said control surface is planar.

4. The closure in accordance with claim 1, wherein said body has a central axis, and said abutment comprises a base having a first cross-sectional area and a post that projects from said base and that has a second cross-sectional area, said first and second cross-sectional areas taken in a plane perpendicular to said central axis, said second cross-sectional area being sized such that said post is sheared from said base by said striker rib when said force is greater than said predetermined force.

5. The closure in accordance with claim 1 in which said engaging surface is planar.

6. The closure in accordance with claim 1 in which said body has a transverse deck; and said abutment extends upwardly from said deck.

7. In a toggle-action dispensing closure structure for an opening to a container wherein said closure includes:

a body for engaging said container over said opening and defining a discharge aperture communicating with said opening; and an actuator pivotally mounted on said body on a tilting axis for occluding flow from said container through said discharge aperture when said actuator is in a closed non-dispensing position and for permitting flow from said container when force is applied to said actuator to tilt said actuator to an open dispensing position, said body having a movable abutment under said actuator when said actuator is in said non-dispensing position, said abutment arranged for confronting said actuator when said actuator is in said non-dispensing position to prevent tilting of said actuator to said dispensing position in response to said actuator being subjected to a force less than a predetermined force, but moving said abutment when said actuator is subjected to at least said predetermined force so that thereafter said actuator can be tilted to said dispensing position in response to the application of force less than said predetermined force, the improvement comprising:

said movable abutment including a base and a post projecting from said base, said post extending in a first direction from said base toward said actuator, said post having a forwardly facing surface and a rearwardly facing surface, said base defining a fracture control surface at the bottom of said post, and said fracture control surface extending rearwardly of said post rearwardly facing surface and forwardly of said post forwardly facing surface generally along a plane that is oblique to said first direction.

8. The closure structure in accordance with claim 7 wherein said control surface extends laterally on opposite sides of said post.

9. The closure structure in accordance with claim 8 wherein said control surface is generally planar and is inclined at about 60 degrees to the first direction.

10. The closure structure in accordance with claim 7, wherein:

said post projects upwardly from said base, said post having a planar engagement surface arranged to be contacted by said actuator, said base having a planar front face below said post;

said post has a front surface facing in a direction opposite to the direction in which said planar engagement surface faces; and said front surface of said post is stepped from said base front face.

11. The closure structure in accordance with claim 10, wherein said fracture control surface slopes downwardly from a high side located outwardly from said post to a low side located inwardly from said post, said high side being further away from said tilting axis than said low side is from said tilting axis.

12. The closure structure in accordance with claim 7, wherein said actuator comprises a striker rib arranged to fracture said post upon tilting of said actuator into said dispensing position, said striker rib comprises an engagement plate arranged to contact said post, and a backing rib formed with said engagement plate on a rear side of said engagement plate.

13. The closure structure in accordance with claim 7, wherein said actuator comprises a lug having an engagement surface, and said body comprises an engagement edge that confronts said engagement surface when said actuator is in said non-dispensing position, said engagement surface and said engagement edge being sufficiently resilient to distort to allow said engagement end to pass by said engagement edge only if a sufficient tilting force is exerted on said actuator.

14. A toggle-action dispensing closure structure, comprising:

a closure body having a peripheral wall and a deck substantially closing said peripheral wall except for having a dispensing aperture therethrough, said deck having a rear edge; and an actuator hingedly connected to said closure body on a tilting axis, said actuator having a closing surface which (1) closes said aperture when said actuator is tilted about said tilting axis into a first position, and (2) opens said aperture when said actuator is tilted about said tilting axis into a second position, said body having a movable post extending generally perpendicularly from said deck at a position between said deck rear edge and said tilting axis, said post having a rearwardly facing engaging surface, said actuator including a downwardly extending striker rib in a position behind said post when said actuator is initially in said first position and arranged to engage and move said post as said actuator is tilted forcefully to said second position, said striker rib being located sufficiently close to said post so that said striker rib engages said post as said actuator moves toward said second position but before said dispensing aperture begins to open, said striker rib having a front surface generally in registry with said post rearwardly facing engaging surface when said actuator is in said first position.

15. The closure structure according to claim 14, wherein said body includes a base that (1) supports said post, and (2) defines a generally planar fracture surface located at the bottom of said post and extending at an oblique angle from rearwardly of said post to forwardly of said post.

16. The closure structure according to claim 15, wherein said base is wider than said post; and said fracture control surface extends beyond the sides of said post in either direction generally laterally of said post.

17. The closure structure according to claim 14, wherein said striker rib has a T-shaped cross-section taken through a plane parallel to said tilting axis.

18. The closure structure according to claim 14, wherein said post has a pre-selected cross-section and rigidity so that said post breaks when moved by said striker rib.

19. The closure structure according to claim 14, wherein said post is bent when moved by said striker rib.

20. The closure structure according to claim 14, wherein a surface of said post that is contacted by said striker rib is located at a distance from said tilting axis that is about 65% of the distance between the rear edge of the actuator and the tilting axis.

21. The closure structure according to claim 14, wherein said actuator comprises a lug at a rear edge thereof having an inclined end, and said closure body includes an edge which engages with said inclined end when said actuator is in said first position on said body and resiliently disengages with said inclined end when said actuator is forcibly tilted toward said second position.

22. The closure structure according to claim 14, wherein said actuator comprises a pressing surface on an outside thereof for forcible pivoting of said actuator to said dispensing position, said pressing surface extending to a rear edge of said actuator at a distance from said tilting axis, and said striker rib located between said tilting axis and said rear edge of said actuator.

* * * * *